US006309169B1

(12) United States Patent
Carlile

(10) Patent No.: US 6,309,169 B1
(45) Date of Patent: Oct. 30, 2001

(54) PUMP DEPLOYMENT SYSTEM

(75) Inventor: Donald G. Carlile, Gresham, OR (US)

(73) Assignee: Roper Holdings, Inc., Wilmington, DE (US)

( * ) Notice: Subject to any disclaimer, the term of this patent is extended or adjusted under 35 U.S.C. 154(b) by 0 days.

(21) Appl. No.: 09/434,762

(22) Filed: Nov. 4, 1999

(51) Int. Cl.[7] ..... B65G 67/02; F04B 17/06

(52) U.S. Cl. ..... 414/498; 414/812

(58) Field of Search ..... 414/498, 812, 414/495, 496, 499, 500, 501, 502, 503, 504, 505; 239/722, 723; 405/87; 169/13, 51, 52, 24; 415/119; 137/899; 417/231, 232

(56) References Cited

U.S. PATENT DOCUMENTS

| | | | | |
|---|---|---|---|---|
| 2,834,599 | | 5/1958 | Sarchet | 414/498 X |
| 3,289,868 | | 12/1966 | MIller et al. | 414/498 X |
| 3,773,199 | | 11/1973 | Arvidsson | 414/498 |
| 4,522,550 | | 6/1985 | Whitehouse | 414/498 |
| 5,392,814 | * | 2/1995 | Brotcke et al. | 137/899 |
| 5,593,272 | * | 1/1997 | Green | 414/498 |
| 5,624,225 | | 4/1997 | Cox | 414/498 X |
| 5,788,410 | * | 8/1998 | Stucks | 405/87 |
| 5,800,114 | * | 9/1998 | Secondi | 414/498 X |

* cited by examiner

*Primary Examiner*—Robert P. Olszewski
*Assistant Examiner*—Gerald J. O'Connor
(74) *Attorney, Agent, or Firm*—Kolisch, Hartwell, Dickinson, McCormack & Heuser

(57) ABSTRACT

A pump deployment system having a frame adapted to be loaded on a trailer, a pump/engine unit mounted on the frame, and jacks secured to the frame. The jacks are adapted such that, when the frame is loaded on a trailer, the jacks can be engaged with a ground surface supporting the trailer, the jacks being operable to selectively raise the frame to allow the trailer to be removed from underneath the frame, the jacks being further operable to lower the frame toward the ground surface so that the pump/engine can be placed in a semi-permanent configuration.

25 Claims, 4 Drawing Sheets

PUMP DEPLOYMENT SYSTEM

BACKGROUND

The present invention relates generally to pump/engine units, and particularly to a deployment system for a portable, trailer-mounted pump/engine unit. The system allows the pump/engine unit to be easily removed from a trailer and installed in a semi-permanent operating configuration.

Portable pump/engine units are used in a wide variety of applications. They are used in irrigation and construction applications, to de-water pits, to maintain areas subject to infiltration flooding in a dry condition, and to recover low-lying land otherwise suitable for farming. Portable pumps are also used in wastewater treatment applications to augment normal pumping facilities or to act as a bypass pump in the event of failure of the primary pumping system. The time, effort and expense of deploying a pump are especially important considerations in wastewater applications, which often require speedy deployment of pumps and frequent moving of pumps from one location to another.

Pump/engine units can weigh many tons, and thus are often mounted on trailers to achieve the desired portability. In many trailer-mounted designs, the pump/engine unit is permanently mounted to the trailer and may be operated while in its mounted configuration. In other designs, the pump/engine unit is removed from the trailer and placed on or close to the ground in a semi-permanent or permanent operating configuration. Depending on the pumping application, there are a number of advantages to removing a pump/engine unit from a trailer for non-mounted operation.

One significant advantage of removing a pump/engine unit from its trailer is that removal allows the pump to be operated closer to the ground or other supporting surface. Lowering the pump reduces the suction lift facing the pump in lift applications where the pump draws from a vessel or reservoir located below the level of the pump. A lower suction lift allows the pump to operate at higher volumes and efficiency and with less strain and wear on the pump and engine. In addition to reducing the suction lift, removing the pump/engine unit from a trailer and lowering it to the ground increases the stability of the pump/engine unit, as the pump skid can now be installed in a permanent configuration.

A further advantage of designs having removable pump/engine units is that they allow for increased flexibility in trailer design and in the deployment of the pump/engine units. For example, trailers not specifically adapted for use with pump/engine units may be used to transport and deploy the pump/engine unit. Also, a single trailer can be used to transport and deploy more than one pump, in either the same or different locations. Yet another advantage of removing a pump/engine unit from its trailer is increased protection against theft—a pump/engine unit placed on the ground is more difficult to move than a pump/engine unit mounted on a parked trailer.

In known pump deployment systems, the pump/engine unit is removed from a trailer using a crane, hoist or similar device that engages a hook provided on a top portion of the unit. Providing a crane at the location where the pump is to be deployed is inconvenient and increases the time and expense of placing the pump in its operating configuration. These problems are magnified in applications requiring frequent and/or speedy movement of pump units from one location to another. The inconvenience and increased time and expense of using a crane are particularly serious problems in emergency situations where quick deployment of a pump is critical, such as in the event of a failed primary pumping system in a wastewater treatment system.

DETAILED DESCRIPTION

Figure 1:
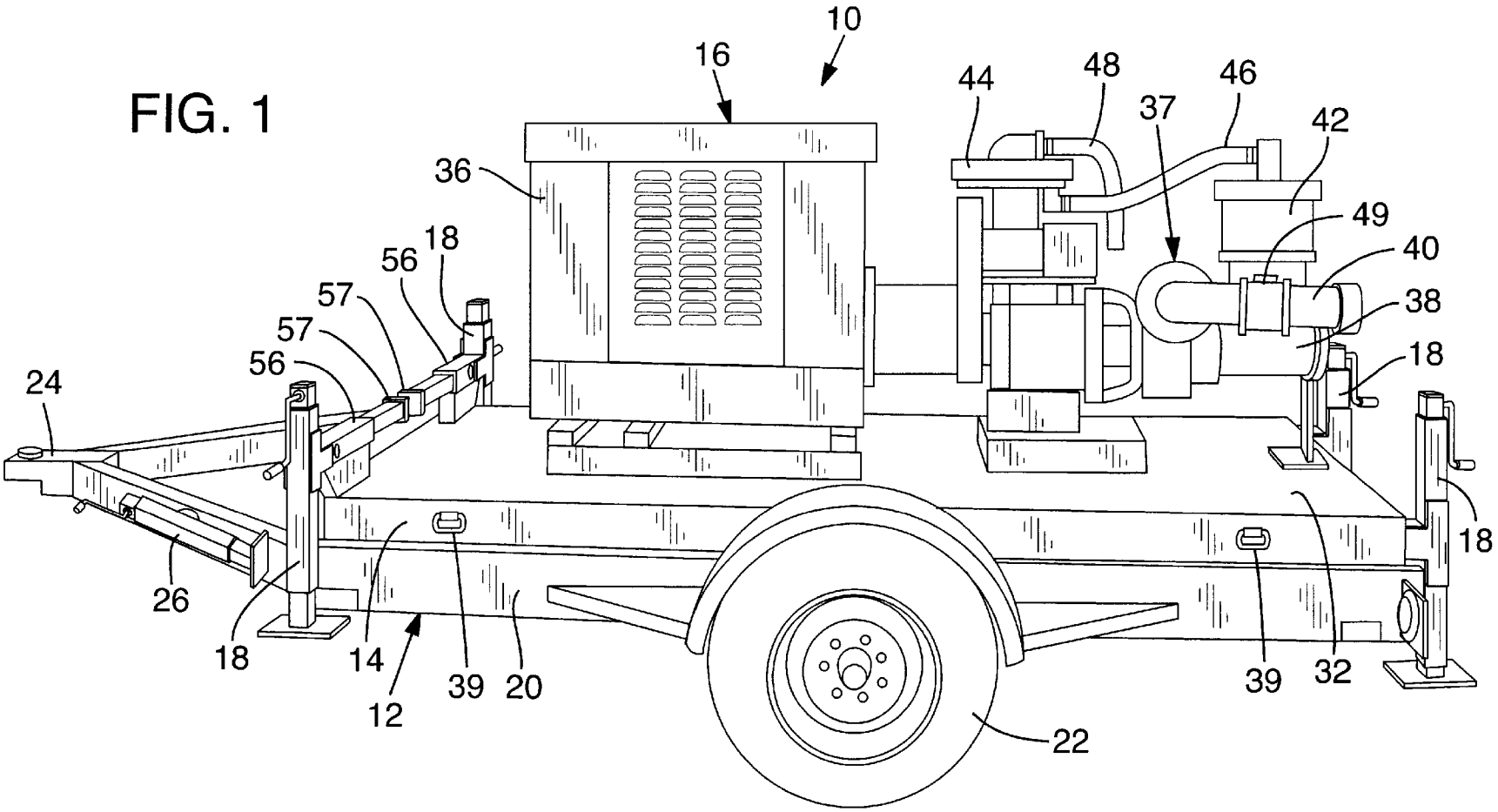
FIG. 1 is a side view of a pump deployment system according to the present invention.

FIG. 1 depicts a pump deployment system 10 constructed according to the present invention. The principal components of the system are a trailer 12, a pump skid or frame 14 that is adapted to be loaded on and carried by the trailer, a pump/engine unit 16 mounted on the frame, and jacks 18 secured to the frame. The jacks are adapted so that they can be engaged with a ground surface supporting the trailer when the frame and pump/engine unit are loaded on the trailer. The jacks are operable to selectively raise the frame from trailer bed 20 to allow the trailer to be removed from underneath the frame. The jacks are further operable to lower the frame after the trailer has been removed so that the frame and pump/engine unit can be placed closer to, or on the ground surface for operation in a semi-permanent or permanent configuration.

Figure 5:
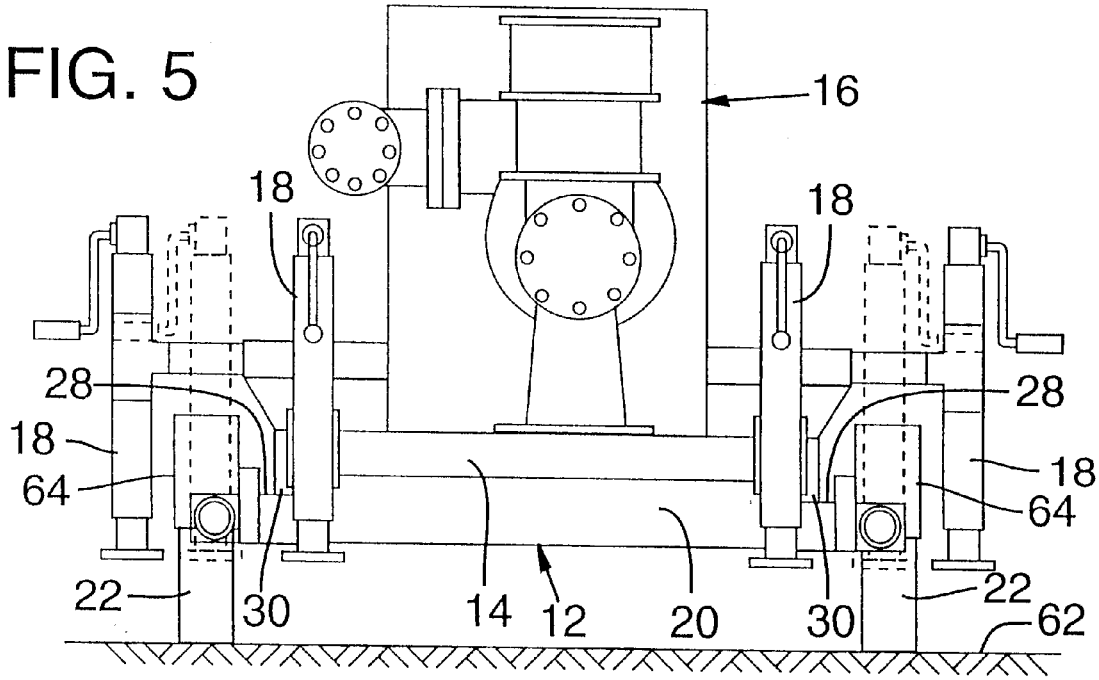
FIG. 5 is a rear view of the pump deployment system of FIG. 1.

Trailer 12 is specially adapted to transport and deploy pump engine/unit 16, though any appropriately dimensioned trailer sturdy enough to support the frame and pump/engine unit can be used. Trailer 12 has wheels 22, a hitch 24 for attachment to a towing vehicle, and a parking jack 26 provided near the front of the trailer to support the trailer when the trailer is disconnected from a towing vehicle. As best seen in FIG. 5, trailer bed 20 has elongate grooves 28 for receiving two elongate rail portions 30 provided on a bottom portion of frame 14. Although trailer 12 is depicted as carrying a single pump/engine unit, the trailer can easily be modified to transport and deploy multiple pump/engine units.

Figure 2:
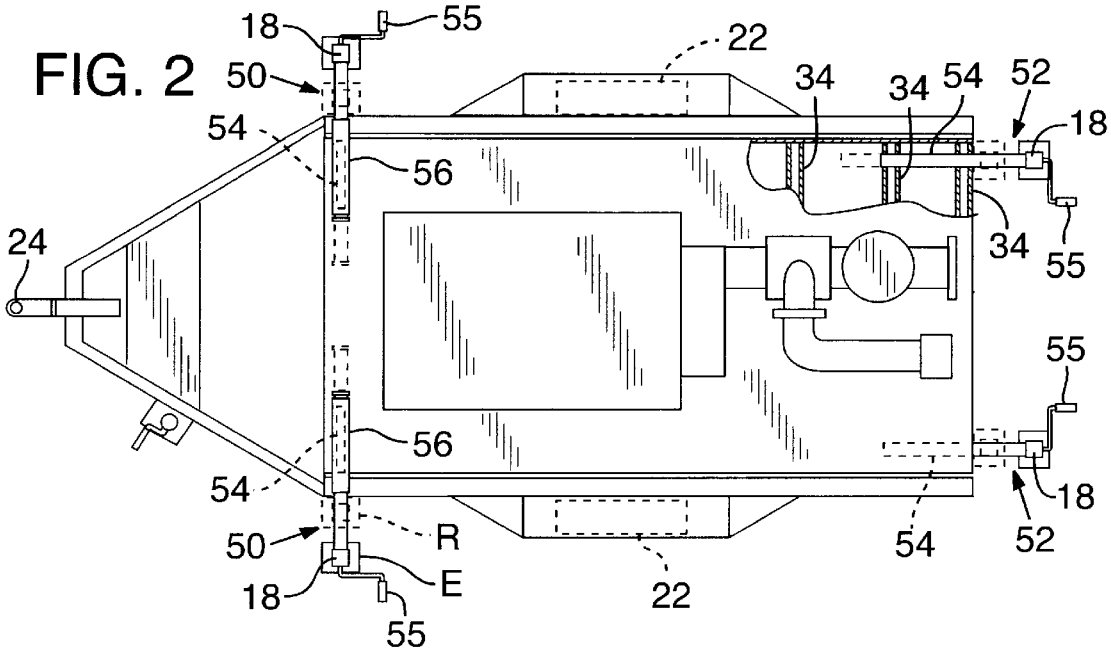
FIG. 2 is a top view of the pump deployment system of FIG. 1.
Figure 4:
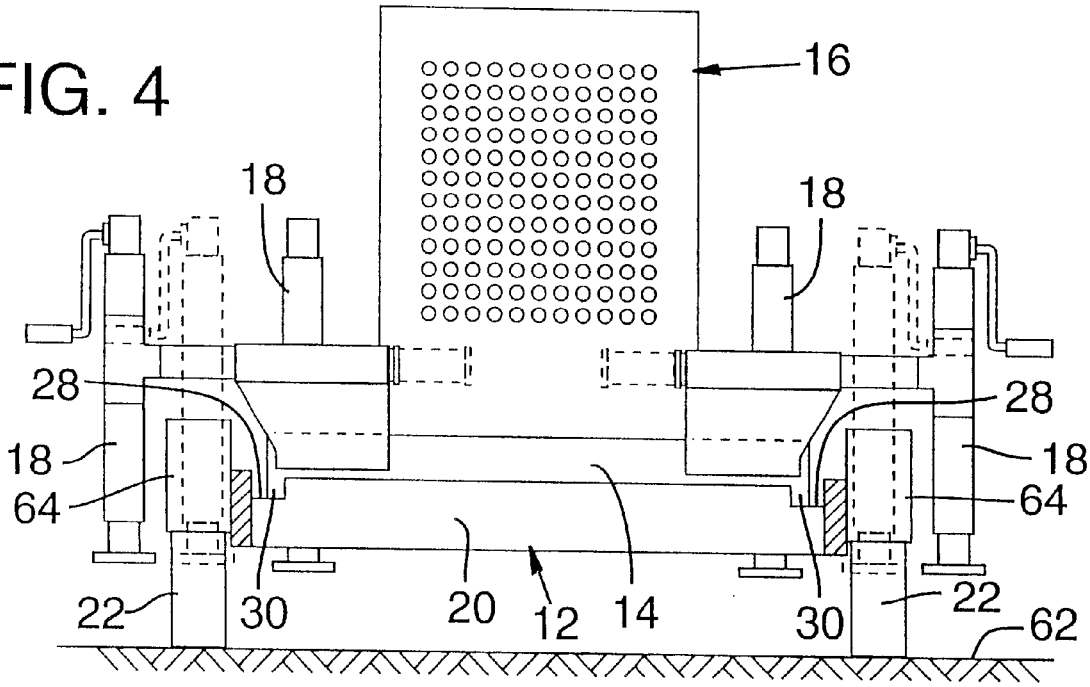
FIG. 4 is a front view of the pump deployment system of FIG. 1.

Frame 14 has a flat upper surface 32 and is strengthened by a number of support beams 34 provided on the underside of the frame, as shown in FIG. 2. Support beams 34, which extend between rail portions 30, rest on the top surface portion of trailer bed 20 between elongate grooves 28 when the frame is mounted on trailer 12. Rail portions 30 extend along the sides of the frame perpendicular to support beams 34. When the frame is loaded on trailer 12, rail portions 30 are received within elongate grooves 28, as best seen in FIGS. 4 and 5, so that the trailer securely supports the frame and prevents it from sliding during transport. Alternatively, the frame can be formed so that the jacks are secured to a skid included on a bottom portion of the frame, where the frame is adapted so that the skid rests on the trailer bed when the frame and pump/engine unit are loaded on the trailer. Frame 14 also includes mounting structures such as D-rings 39 for securing frame 14 to a ground surface when the pump/engine unit is deployed in a semi-permanent or permanent configuration.

Pump/engine unit 16 is preferably a type suited to wastewater treatment applications, such as the Pump Station Bypass system manufactured by Cornell Pump Manufacturing Corporation. Pump/engine unit 16 includes an engine 36 and a centrifugal-type pump 37 that has an impeller (not shown), an input 38 and an output 40. The pump unit is equipped with a self-priming system, such as that described in U.S. patent application Ser. No. 09/258,833, filed Feb. 26, 1999, the disclosure of which is incorporated herein by reference.

The self-priming system includes a float box 42 and a vacuum pump unit 44 having an intake hose 46 and an exhaust hose 48. Engine 36 powers vacuum pump unit 44, which primes the pump by generating a vacuum to draw air out of the pump's input line and replace the air with fluid to be pumped by the impeller. The vacuum pressure draws air from the input line through float box 42 and intake hose 46, and discharges the air out through exhaust hose 48. Eventually, the vacuum pressure draws all of the air out of the input line and replaces it with the fluid to be pumped. The fluid in the input line causes a float to rise and close a valve included in float box 42, at which point the pump is primed and the fluid is pumped by the impeller and discharged through pump output 40. A check valve 49 prevents air or water from being drawn back through the pump output during priming.

Engine 36 is preferably a gasoline engine ranging from 30 to 250 horsepower, though engines having other power ratings and running on alternate fuels, such as propane or natural gas, may be used. In addition, the pump may be powered by hydraulic or electric sources. If desired, pump/engine unit 16 can be enclosed on frame 14 with a weatherproof, sound attenuating enclosure. Such an enclosure is particularly desirable when the pump/engine unit is operated in a residential area.

As seen in FIG. 2, the pump deployment system includes a front pair of jack assemblies 50 and a rear pair of jack assemblies 52. Each assembly has a jack 18 and an extension member 54 securing the jack to the frame. Jacks 18 each include a crank 55 for raising and lowering the jack. Extension members 54 are slidably engaged with frame 14, and are elongate and oriented perpendicular to the jack to which they are attached. As best seen in FIG. 1, the extension members for the front pair of jacks are slidably disposed within tube members 56 provided on the top surface 32 of frame 14. The rear pair of extension members are slidably disposed within holes defined transversely through the support beams included on the underside of frame 14. Preferably, extension members have a square or rectangular cross-sectional shape, though other suitable shapes may be used. Holes and the interior of tube members 56 are slightly larger than the extension members to permit the extension members to slidably extend and retract from the frame.

Because the extension members are slidably engaged with the frame, the jacks can be selectively extended sideways outward from the frame in a direction parallel to the length of the extension members and retracted back toward the frame, as shown in FIG. 2. This allows the jacks to be shifted between a retracted position R and an extended position E, with the jacks being spaced further from the frame when in the extended position than when in the retracted position. The ends of extension members 54 that are not attached to jacks 18 are provided with a removable stop 57, such as a pin or oversize plate, to prevent the jacks from being extended outward beyond extended position E. The stops can be removed so that the jack assemblies can be removed from the frame. Extension members 54 are sized such that, when the jacks are placed in the extended position and used to raise the frame from the trailer bed, the jacks are sufficiently spaced from the frame so that they will not obstruct the trailer wheels when the trailer is removed from underneath the frame. FIGS. 4 and 5 show the front jacks in the extended position, and reveal that trailer 12 may be removed from underneath the frame without being obstructed by the front pair of jacks 18.

Figure 3:
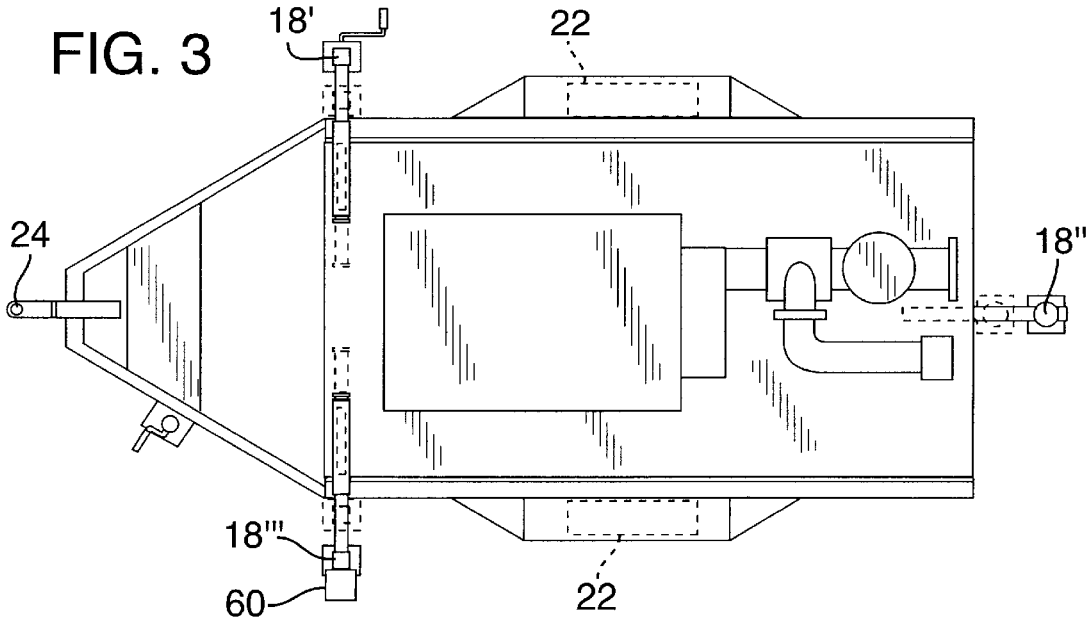
FIG. 3 is a top view of an alternate embodiment of the pump deployment system.

FIG. 3 shows an alternate configuration of the pump deployment system that has three jacks 18', 18" and 18'". In some settings, using three jacks increases the stability of the frame as it is raised and lowered by the jacks. Jack 18' has a jack screw received through an internally threaded jack barrel, jack 18" is a hydraulic jack, and jack 18'" is powered by a motor 60 for selectively raising and lowering the frame. In addition, a jack having a rack and pinion mechanism could be used. Virtually any type of jacking device can be used with the pump deployment system of the present invention.

In addition to these examples showing different numbers and types of jacks, it should be appreciated that any number of configurations may be used for the jack assemblies of the invented pump deployment system. For example, the deployment system depicted in FIG. 2 has two jacks secured to the rear portion of the frame. These jacks could easily be secured to various points along the side of the frame, while still providing the necessary support and stability for the frame and pump/engine unit. All that is required of a particular jack assembly configuration is that it securely support the frame as it is raised and lowered.

Figure 6A:
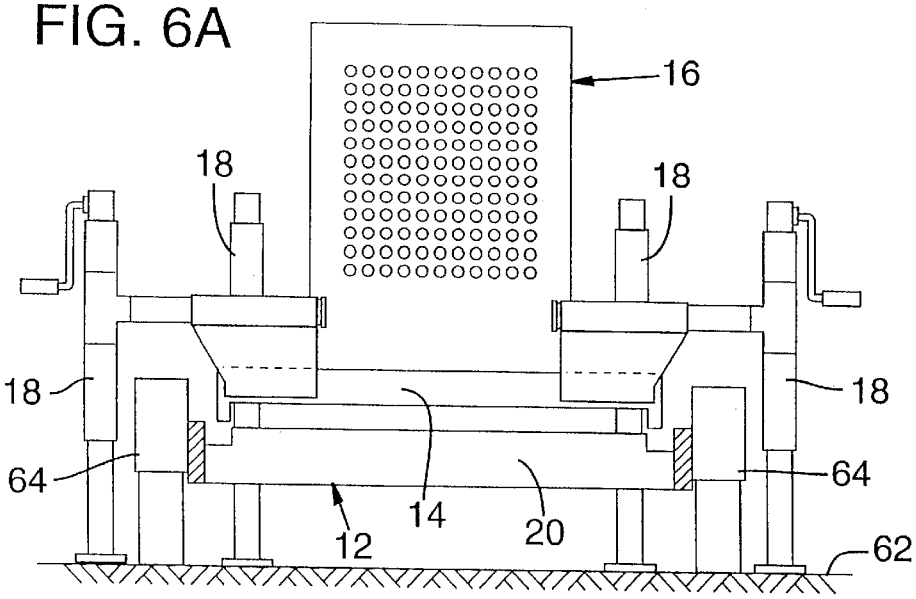
FIGS. 6A, 6B and 6C are front views showing a pump/engine unit according to the present invention being removed from a trailer and deployed in a semi-permanent operating configuration.
Figure 6B:
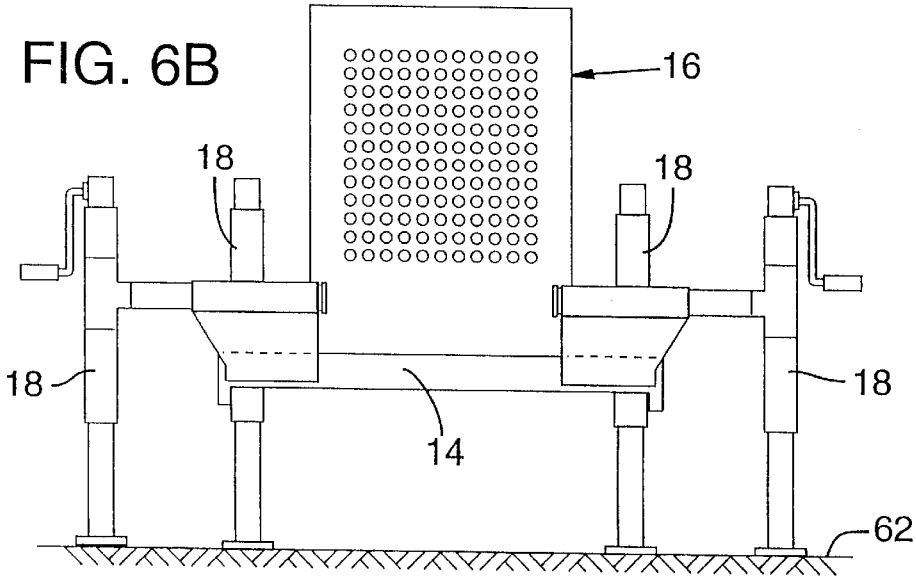
Figure 6C:
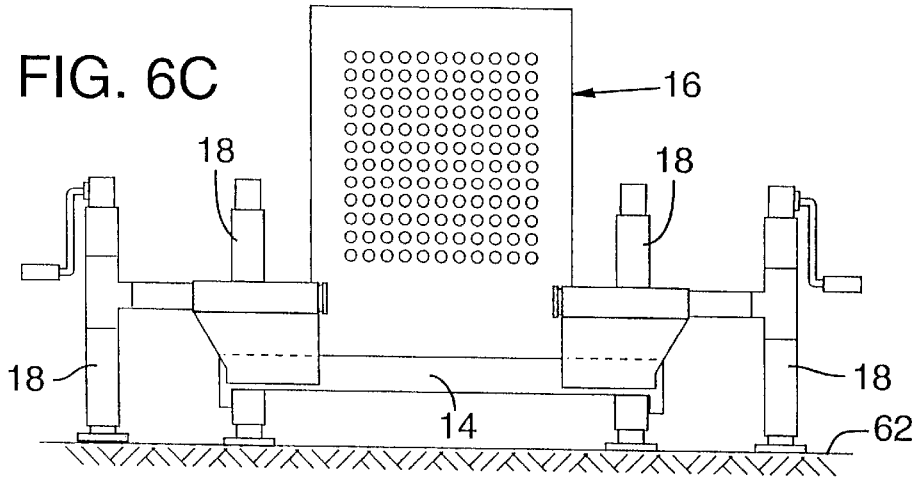

Referring now to FIGS. 4, 5, 6A, 6B and 6C, a method of deploying the pump in a semi-permanent operating configuration will be described. Staring with pump/engine unit 16 and frame 14 loaded on trailer 12, the trailer is first moved to a desired location where the pump/engine unit is to be installed for operation in a semi-permanent configuration. Jacks 18 are placed in the extended position, as shown in FIGS. 4 and 5, and are then engaged with a ground surface 62. Jacks 18 are then used to raise the frame and pump/engine unit from the trailer so that the frame is spaced from the trailer bed, and so that the extension members clear the tops of fenders 64. Trailer 12 is then removed from underneath the frame, and jacks 18 are used to lower the frame and pump/engine unit toward the ground so that the unit can be operated in a semi-permanent configuration, as shown in FIGS. 6B and 6C.

Removing the pump/engine unit from the trailer for operation close to or on the ground decreases the suction lift facing the pump, increases the stability of the pump/engine unit, and offers increased protection against theft by making the pump/engine unit more difficult to move. The unit can be even further protected against theft by removing the jack assemblies from the frame, as previously described. Removal also allows for increased flexibility in trailer design and in the transport and deployment of the pump/engine unit. These advantages are obtained in the invented deployment system without the use of a crane, hoist or similar device for removing the pump/engine unit from the trailer. The integrated jack assemblies allow the pump/engine unit to be deployed faster, easier and at less expense than units deployed with a crane. These advantages make the system especially useful in the numerous pumping applications that require frequent and/or speedy deployment of pumps. The deployment system is particularly well suited to wastewater applications where the pump is semi-permanently configured to operate as a bypass pump for a municipal sewage lift station.

While the invention has been disclosed in its preferred form, the specific embodiments thereof as disclosed and illustrated herein are not to be considered in a limiting sense as numerous variations are possible. Applicant regards the subject matter of his invention to include all novel and non-obvious combinations and subcombinations of the various features, functions, elements and/or properties disclosed herein. No single feature, function, element or property of the disclosed embodiments is essential. The following claims define certain combinations and subcombinations that are regarded as novel and non-obvious. Other combinations and subcombinations of features, functions, elements and/or properties may be claimed through amendment of the present claims or presentation of new claims in this or a related application. Such claims, whether they are different, broader, narrower or equal in scope to the original claims, are also regarded as included within the subject matter of applicant's invention.

I claim:

1. A pump deployment system, comprising:

a pump/engine unit having an input and an output;

a frame adapted to be loaded on a trailer, where the pump/engine unit is mounted on the frame; and jacks secured to the frame and configured to engage a ground surface and enable selective raising and lowering of the frame relative to the ground surface, allowing the frame to be loaded onto and unloaded from the trailer, wherein at least some of the jacks are movable relative to the frame in a sideways direction from a retracted position to an extended position, in which the at least some of the jacks accommodate removal of the trailer from underneath the frame without obstructing wheels of the trailer.

2. The pump deployment system of claim 1, further comprising extension members securing the at least some of the jacks to the frame, the extension members being adapted to selectively extend the at least some of the jacks sideways outward from the frame and retract the jacks back toward the frame, such that the jacks can be shifted between the retracted position and the extended position, the at least some of the jacks being spaced further from the frame when in the extended position than when in the retracted position.

3. The pump deployment system of claim 2 further comprising stops removably secured to each extension member to prevent the at least some of the jacks from being shifted beyond the extended position, wherein the stops can be removed to allow the extension members and the at least some of the jacks to be removed from the frame.

4. The pump deployment system of claim 2, wherein the extension members are elongate and generally perpendicular to the at least some of the jacks, and wherein the at least some of the jacks are extended and retracted with respect to the frame in a direction parallel to the length of the respective extension member.

5. The pump deployment system of claim 2, wherein the extension members are slidably engaged with the frame.

6. The pump deployment system of claim 2, wherein the frame further comprises tubes for slidably receiving the extension members.

7. The pump development system of claim 1, wherein the frame further includes D-rings for securing the frame and pump/engine unit to a ground surface.

8. The pump deployment system of claim 1 further comprising a motor powering the jacks to selectively raise and lower the frame.

9. The pump deployment system of claim 1, wherein the at least some of the jacks include a jack pair secured to the frame in a location which is forward of the wheels of the trailer when the frame is loaded onto the trailer, and where the jack pair is transversely slidable inward and outward relative to the frame between the retracted position and the extended position.

10. The pump deployment system of claim 9, wherein if the jack pair were used to support the frame when in the retracted position, the jack pair would obstruct the wheels of the trailer upon attempted removal of the trailer from underneath the frame, and wherein the jack pair permits unobstructed removal of the trailer from underneath the trailer when jack pair is used to support the frame in the extended position.

11. The pump deployment system of claim 10, wherein the jacks are configured to completely support the frame and pump/engine unit independent of the trailer, the jacks being further configured to assist in loading and unloading the frame by supporting the frame above the ground surface to permit the trailer to move in and out from underneath the supported frame.

12. The pump deployment system of claim 1, wherein the at least some of the jacks are operable to aid in raising and lowering the frame in either of the retracted position and the extended position, and wherein if the at least some of the jacks were used to support the frame when in the retracted position, the at least some of the jacks would obstruct the wheels of the trailer upon attempted removal of the trailer from underneath the frame, and wherein the at least some of the jacks permit unobstructed removal of the trailer from underneath the frame when used to support the frame in the extended position.

13. A pump deployment system, comprising:

a frame;

a pump/engine unit mounted on the frame;

a trailer adapted to receive the frame and pump/engine unit; and jacks secured to the frame and configured to engage a ground surface and enable selective raising and lowering of the frame relative to the ground surface, allowing the frame to be loaded onto and unloaded from the trailer, wherein at least some of the jacks are movable relative to the frame in a sideways direction from a retracted position to an extended position, in which the at least some of the jacks accommodate removal of the trailer from underneath the frame without obstructing wheels of the trailer.

14. The pump deployment system of claim 13 further comprising extension members securing the at least some of the jacks to the frame, the extension members being adapted to selectively extend the at least some of the jacks sideways outward from the frame and retract the at least some of the jacks back toward the frame, such that the at least some of the jacks can be shifted between the retracted position and the extended position, the jacks being spaced further from the frame when in the extended position than when in the retracted position.

15. The pump deployment system of claim 14, wherein the extension members are elongate and generally perpendicular to the at least some of the jacks, and wherein the at least some of the jacks are extended and retracted with respect to the frame in a direction parallel to the length of the respective extension member.

16. The pump deployment system of claim 14, wherein the extension members are slidably engaged with the frame.

17. The pump deployment system of claim 14, wherein the frame further comprises tubes for slidably receiving the extension members.

18. The pump deployment system of claim 13, wherein the pump/engine unit further comprises a self-priming system having a vacuum pump for removing air from an input line secured to an input of the pump/engine unit.

19. The pump deployment system of claim 13 further comprising a motor powering the jacks to selectively raise and lower the frame.

20. The pump deployment system of claim 13, wherein the at least some of the jacks include a jack pair secured to the frame in a location which is forward of the wheels of the trailer when the frame is loaded onto the trailer, and where the jack pair is transversely slidable inward and outward relative to the frame between the retracted position and the extended position.

21. The pump deployment system of claim 20, wherein if the jack pair were used to support the frame when in the retracted position, the jack pair would obstruct the wheels of the trailer upon attempted removal of the trailer from underneath the frame, and wherein the jack pair permits unobstructed removal of the trailer from underneath the trailer when jack pair is used to support the frame in the extended position.

22. The pump deployment system of claim 21, wherein the jacks are configured to completely support the frame and pump/engine unit independent of the trailer, the jacks being further configured to assist in loading and unloading the frame by supporting the frame above the ground surface to permit the trailer to move in and out from underneath the supported frame.

23. The pump deployment system of claim 13, wherein the at least some of the jacks are operable to aid in raising and lowering the frame in either of the retracted position and the extended position, and wherein if the at least some of the jacks were used to support the frame when in the retracted position, the at least some of the jacks would obstruct the wheels of the trailer upon attempted removal of the trailer from underneath the frame, and wherein the at least some of the jacks permit unobstructed removal of the trailer from underneath the frame when used to support the frame in the extended position.

24. A pump deployment system, comprising:

a pump/engine unit having an input and an output;

a frame adapted to be loaded on a trailer, where the pump/engine unit is mounted on the frame; and jacks secured to the frame and configured to engage a ground surface and enable selective raising and lowering of the frame relative to the ground surface, wherein:

the jacks are configured to completely support the frame and pump/engine unit above the ground surface independent of the trailer, to permit loading and unloading of the frame by moving the trailer in and out from underneath the supported frame;

the jacks include a jack pair positioned on the frame so as to be forward of a set of wheels of the trailer when the frame is loaded onto the trailer; and the jack pair is slidable inward and outward relative to the frame in a sideways direction between a retracted position and an extended position, such that if the jack pair were used in the retracted position to support the frame off of the trailer, the jack pair would obstruct the wheels of the trailer upon attempted removal of the trailer in a forward direction from underneath the frame, the jack pair being movable into the extended position to accommodate removal of the trailer from underneath the frame without any such obstruction of the wheels of the trailer.

25. A method of deploying a pump unit from a portable trailer-mounted configuration to a semi-permanent configuration, comprising the steps of:

providing a frame having jacks secured to the frame, wherein at least some of the jacks are movable inward and outward in a sideways direction relative to the frame between a retracted position and an extended position;

mounting a pump/engine unit on the frame;

placing the frame and pump/engine unit on a trailer so that the trailer supports the frame;

engaging the jacks with a ground surface supporting the trailer;

using the jacks to raise the frame and pump/engine unit from the trailer so that the frame is spaced from the trailer;

removing the trailer from underneath the frame; and lowering the frame and pump/engine unit toward the ground surface to place the pump/engine unit in the semi-permanent configuration.

wherein the at least some of the jacks are placed in the extended position prior to removing the trailer from underneath the frame in order to accommodate removal of the trailer without the at least some of the jacks obstructing wheels of the trailer.

* * * * *